US005338248A

United States Patent [19]

Sumrack

[11] Patent Number: 5,338,248

[45] Date of Patent: Aug. 16, 1994

[54] VENTILATION APPARATUS FOR REMOVING VAPORS

[75] Inventor: Charles J. Sumrack, Owosso, Mich.

[73] Assignee: Midwest Air Products Co., Inc., Owosso, Mich.

[21] Appl. No.: 8,540

[22] Filed: Jan. 25, 1993

[51] Int. Cl.[5] ..... B08B 15/02

[52] U.S. Cl. ..... 454/49; 204/270

[58] Field of Search ..... 205/94, 145, 137, 210, 205/220; 204/278, 270, 225, 198, 287; 454/49, 66, 67

[56] References Cited

U.S. PATENT DOCUMENTS

| | | | |
|---|---|---|---|
| 1,840,371 | 1/1932 | Sheloon | 454/67 |
| 2,544,769 | 3/1951 | Sperry et al. | 454/66 |
| 2,939,378 | 6/1960 | Zalkind . | |
| 3,106,927 | 10/1963 | Madwed . | |
| 3,205,810 | 9/1965 | Rosenak . | |
| 3,380,371 | 4/1968 | Scheel . | |
| 3,444,802 | 5/1969 | Barton . | |
| 3,481,265 | 12/1969 | Scheel . | |
| 3,564,990 | 2/1971 | Smedes | 454/67 |
| 3,567,614 | 3/1971 | Vauriac . | |
| 4,087,333 | 5/1978 | Naevestad . | |
| 4,150,605 | 4/1979 | Telchuk et al. . | |
| 4,389,923 | 6/1983 | Ludscheidt . | |
| 4,576,613 | 3/1986 | Miline | 454/66 X |
| 4,592,819 | 6/1986 | Suzuki et al. . | |
| 4,714,010 | 12/1987 | Smart . | |
| 4,787,298 | 11/1988 | Hon . | |

FOREIGN PATENT DOCUMENTS

| | | | |
|---|---|---|---|
| 2657067 | 6/1978 | Fed. Rep. of Germany | 454/67 |
| 485617 | 12/1982 | U.S.S.R. | 454/49 |

*Primary Examiner*—Harold Joyce
*Attorney, Agent, or Firm*—Ian C. McLeod

[57] ABSTRACT

A ventilation system for ventilating a process tank (30, 31, 32) containing a liquid ($L_1$, $L_2$ or $L_3$) which produces noxious fumes or vapors. A hood (33, 34 or 35) is provided which has one or more open slots (33A) for continuous venting of the surface of the tank (33) and a door (37) which covers a second slot (33B) which is activated only when there are additional fumes, particularly when fixture or workpiece, such as fixture (12), is removed from the tank (30). The hoods are designed for automatic operation of the doors. The hood is particularly useful for the plating industry or other industries where noxious fluids in tanks need to be vented.

43 Claims, 6 Drawing Sheets

VENTILATION APPARATUS FOR REMOVING VAPORS

BACKGROUND OF THE INVENTION (1) Field of the Invention

The present invention relates to a new ventilation hood for tanks containing liquids which vent vapors, wherein the hood allows a variable amount of air to flow depending upon the work condition of the tank being vented. In particular, the present invention relates to a continuous ventilation system for tanks which release process fumes (vapors). The system demands low amounts of air for a particular ventilation hood for a tank when the tank is at rest and higher amounts of air when more fumes are being generated by the tank such as when workpieces are removed from the tank. The ventilation system is particularly adapted for an in line plating process.

(2) Prior Art

In recent years the electroplating industry and other users of industrial fluids have been paying increasing attention to the discharge of undesirable chemicals into the environment. Pollution by means of discharge of rinse water and air pollution by discharge of fumes or vapors from hot electroplating baths and toxic surface baths have become a major concern. The list of pollutants continues to grow based upon the EPA findings of new chemicals that are considered carcinogenic (cancer causing) materials. Loss of pollutants from a processing facility also has a direct bearing on economics of plant operation because the pollutants include chemical values, the loss of which must be made up by addition to the tank. The traditional way of handling the air pollution or ventilation of tank surfaces has been to incorporate hoods at the tank surface, a random length of duct and a fan. Not too many years ago this was considered an acceptable means of ventilating a facility.

In recent years, OSHA, the EPA and the DNR (Department of Natural Resources) have developed guidelines for indoor air quality, exhausted air quality and quantity of particulate or fume vapors being released from these processing facilities. Therefore, standards have been set which dictate air volume over a process to capture of vapors from the workpieces as they are removed from the bath. As a result, large amounts of air are constantly being exhausted from the facility, including the area above the process bath even when no parts being treated are being removed from the tank. These increased amounts of air require larger ducting, scrubbing devices and fans. The unseen items that go along with having this basically clean air being continuously exhausted is a larger air make-up unit to introduce fresh air to the facility to replenish the air being exhausted from the facility. Additional effluent is discharged to and must be treated by the waste treatment system. Higher electrical costs, higher maintenance costs and additional floor space are required to handle these larger systems that are removing air continuously from all the baths at both the tank surface and above the tank surface when there is a need to only continuously remove the air from the tank surface and periodically from above the tank surface.

There is a need to maintain total control over the tank surface with periodic and on demand above tank fixture ventilation, thus significantly decreasing the amount of air being exhausted from the facility on a continuous basis. This reduction in exhausted air will result in a significant reduction in the overall sizing and cost of the ventilation system. This would save the user thousands of dollars on the original purchase of the equipment, and also significantly reduce the overall operating costs of ventilating the process system. Thus, there would be reduced power consumption, treatment costs, air make-up requirements, including heating and cooling of the facility, and overall maintenance for an improved system.

The patent art has described ventilating systems of various types. Illustrative are U.S. Pat. No. 2,939,378 to Zalkind which shows a moveable or collapsible ventilation unit. U.S. Pat. No. 3,106,927 to Madwed shows a system with a closed top for a tank and doors which open and close to allow a workpiece into the closed top. The workpieces move down into the tank as a rail section is lowered on support columns. U.S. Pat. No. 3,205,810 to Rosenak shows an adjustable hood which covers a furnace mouth. U.S. Pat. No. 3,380,371 to Scheel describes a ventilation system for covering a pouring ladle using a flexible duct. U.S. Pat. No. 3,444,802 to Barton describes the use of vertical air curtains to seal off an area and to send fumes to an exhaust. U.S. Pat. No. 3,481,265 to Scheel describes a canopy or cover with a damper for regulating the venting from a ladle. U.S. Pat. No. 3,567,614 to Vauriac describes a shielded casing for workpiece handling which can be ventilated, thus recognizing the corrosive nature of plating fluids and the need for shielding. U.S. Pat. No. 4,087,333 to Naevestad describes a cover for a coke oven car which travels with the car. U.S. Pat. No. 4,150,605 to Telchuk et al describes a self-propelled spray booth for larger objects. U.S. Pat. No. 4,389,923 to Ludscheidt describes a moveable exhaust duct for automotive fumes and the like using an overhead system. U.S. Pat. No. 4,787,298 to Hon describes flexible exhaust ducts which are moveable.

U.S. Pat. No. 4,592,819 to Suzuki et al describes a high speed plating system where a single cover is used for exhausting accumulated gases from all of the tanks. The system is essentially closed except for the inlet and the outlet for the workpieces. U.S. Pat. No. 4,714,010 to Smart describes an exhaust ventilation system wherein an exhaust system is provided around the tank which is actuated when a reciprocating cover is opened. A hood is placed over the tank supporting the workpiece to be treated which is lowered into the tank. The tanks are vented as is the hood. The system is complicated and in use the moveable covers are not reliable. The system is also difficult to retrofit to existing plating tanks.

What is needed is an inexpensive, reliable system which can be retrofitted to existing systems, for regulating the amount of air flow through an exhaust system without sacrificing safety in exhausting gases from tanks containing liquids giving off fumes. Particularly included is a reliable system for plating.

OBJECTS

It is therefore an object of the present invention to provide a ventilation system which allows fumes and other vapors to be removed from a liquid surface while conserving the amount of air necessary to accomplish the ventilation. Further, it is an object of the present invention to provide a system which is preferably automatic in operation. Further still, it is an object of the present invention to provide a system which is relatively inexpensive to construct and which is reliable.

Further still, it is an object of the present invention to provide a system which can be easily retrofitted to existing systems. Further still, it is an object of the present invention to provide a system which reduces overhead costs to support the system. These and other objects will become increasingly apparent by reference to the following description and the drawings.

DETAILED DESCRIPTION OF THE PREFERRED EMBODIMENTS

Figure 1:
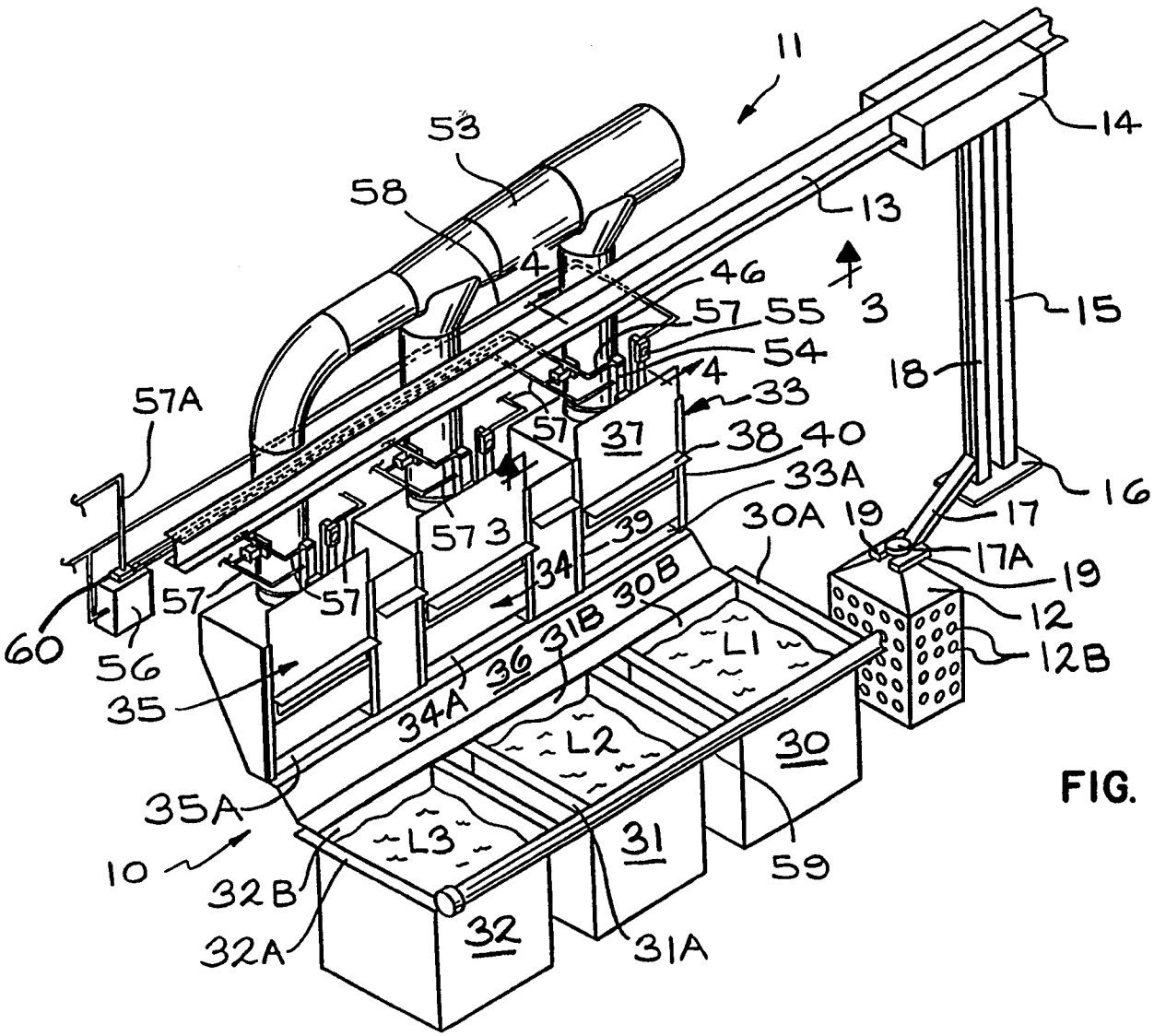
FIG. 1 is an isometric view showing a preferred plating system for exhausting fumes such as from cleaning, plating or washing tanks, 30, 31 or 32.

The present invention relates to an apparatus to be mounted adjacent to a tank means for removing vapors from the tank means which comprises: ventilation hood means to be mounted adjacent to the tank means for removing the vapors and exhausting the vapors from the tank means and having at least one opening into the hood means adjacent the tank means, the one opening having a moveable cover means wherein in use periodically the cover means on the one opening is adapted to open to remove vapors from the tank.

The present invention also relates to an apparatus which comprises: tank means for providing a bath for an article; ventilation hood means for removing vapors from the bath and exhausting the vapors from the hood means mounted adjacent the tank means and having at least one opening into the hood means adjacent to and above an upper surface of the bath, the one opening having a moveable cover means, wherein in use periodically the cover means on the one of the openings is adapted to open as the article is removed from the bath.

The present invention also relates to an electroplating apparatus which comprises: multiple, sequentially arranged tank means providing separate stations for a cleaning bath, a plating bath and rinsing bath for an article which is plated; ventilation hood means for removing vapors from at least one of the baths and exhausting the vapors from the hood means mounted adjacent at least one of the tank means providing one of the baths and having at least one opening into the hood means adjacent to and above an upper surface of the one of the baths, the one opening having a moveable cover means, wherein in use periodically the cover means on the one opening is adapted to open as articles are removed from the one of the baths.

The present invention relates to a method for removing vapors from a bath in a tank means; providing an apparatus to be mounted adjacent to a tank means for removing vapors from the tank means which comprises: ventilation hood means for removing the vapors and exhausting the vapors from the tank means and having at least one opening into the hood means adjacent the tank means, the one opening having a moveable cover means wherein in use periodically the cover means on the one opening is opened to remove vapors from the tank; and removing the vapors from the bath in the tank means with the hood means, wherein the one opening is periodically opened to remove the vapors from the tank.

Finally, the present invention relates to a method for electroplating which comprises: providing an electroplating apparatus which comprises multiple, sequentially arranged tank means providing separate stations for a cleaning bath, a plating bath and rinsing bath for an article which is plated; ventilation hood means for removing vapors from at least the bath used for electroplating and exhausting the vapors from the hood means mounted adjacent the tank means providing one of the baths and having at least one opening into the hood means adjacent to and above an upper surface of the one of the baths, the one opening having a moveable cover means, wherein in use periodically the cover means on the one opening is opened as articles are removed from the bath; and electroplating the article in the tank means using the apparatus, wherein the one opening is opened as articles are removed from the bath.

The present invention particularly relates to an automatic hood for exhaust reduction and point ventilation, for the purpose of vapor (fume or mist) capture on demand at one or more process tanks. The automated multi-slot hood captures fumes on demand from liquid in various chemical process tanks. More particularly, the hood is useful in the electroplating and/or chemical processing industries.

The preferred automated multi-slot hood includes a plastic PVC (fiberglass or the like), or metal fabricated (which can be coated for corrosion resistance) enclosure, preferably with two or more slots for dedicated fume or mist capture at one or more process tank(s) including the fume or mist capture from the workpieces and/or workpieces and fixture (such as fixtures containing the workpieces) being removed from said process tank(s).

Proper airflow in cubic feet per minute (CFM) is calculated in advance so that the velocity through the slots in the hood and the additional static pressure required to properly remove the fume/mist from the process bath and fixture are accounted for. The hood system, preferably automatically, adjusts itself to accommodate either tank surface, fume and/or mist or fixture fume and/or mist removal, thus greatly reducing the volume of required exhausted air as conventional ventilation systems require to insure positive control of process bath surface and fixture emitted fumes or mists.

In the preferred apparatus, all slots in the hood except for the bottom slot, (tank surface ventilation) for each of the fume hoods on all exhausted process baths, are closed, including the individual accompanying dampers in exhaust pipes which are adjusted to a partially closed position, based upon the calculated CFM/velocity/-static pressure required to properly exhaust the bottom open slot on the hood corresponding with each of the vented process baths. The purpose for having the upper slots closed is to minimize the total exhausted air volume required to maintain constant control over the entire system. Additional CFM for the upper slots is calculated and incorporated into the fan, scrubber and duct design to facilitate the upper slots as so desired. The additional CFM is calculated based upon maximum number of lifting devices on the process system (i.e. hoist, crane, sidearm hoist, or any other lifting mechanism being utilized to transfer the fixtures from bath to bath). Once a fixture is lifted out of the process tank, a proximity switch is actuated as a result of the fixture being lifted, thus signaling an input to a computer. The computer determines at which location the upper slots are to be opened, allowing the precalculated CFM to draw the fume from the fixture in the up position. As the slots in the hood are opened so does the corresponding damper, therefore causing a decrease of static pressure and allowing higher CFM volumes to be directed to the open hood slots.

It will be appreciated that a single slot with a partially opened door can be used in the apparatus. When a higher volume of air is necessary, the door can be opened further.

FIG. 1 shows a plating and ventilation system 10 and an overhead rail conveyor 11 for conveying a fixture 12 containing workpieces (not shown) to be plated. The conveyor 11 is of a conventional type and includes a horizontally oriented "I" beam 13 upon which rests a trolley 14 which can be motorized (not shown). A vertically oriented support post 15 is provided with a pad 16 which mounts on a floor or other surface. The post 15 is provided with an arm 17 which is moveable vertically along the post 15 by a motor (not shown) in liner transfer rod 18. The rail 13 is supported by other vertical support posts (not shown) to the right (or to the left) of rail 13. As shown in FIG. 1 the rail 13 is cantilevered over the system 10.

The arm 17 includes fork tines 19 which engage a button 12A of the fixture 12. The tines 19 are designed to slide horizontally off and on the button 12A of fixture 12. The fixture 12 is provided with perforations 12B which allow the liquid $L_1$, $L_2$, $L_3$ in the tanks 30, 31 and 32 to enter and leave the fixture 12 upon immersing and removing the fixture 12 from each tank 30, 31 and 32.

The conveyor system 11 lifts the fixture 12 so that is sequentially immersed and removed from the tanks 30, 31 and 32 so that the part can be cleaned, plated and rinsed in succession by liquids $L_1$, $L_2$ and $L_3$. These are the conventional steps in plating and more or less of the tanks can be used depending upon the processing requirements.

The present invention uses hoods 33, 34 and 35 for each tank 30, 31, 32 respectively. The tanks 30, 31, and 32 are provided with upper lips 30A, 31A and 32A around the upper periphery of the tanks 30, 31 and 32 which provide convenient mounting platforms for the ventilation hoods 33, 34 and 35. An upwardly inclined apron 36 is mounted along the tanks 30, 31 and 32 which directs the air to the hoods 33, 34 and 35. The apron 36 is mounted adjacent to sides 30B, 31B and 32B of the tanks 30, 31 and 32 on portions of the lips 30A, 31A and 32A.

Figure 5:
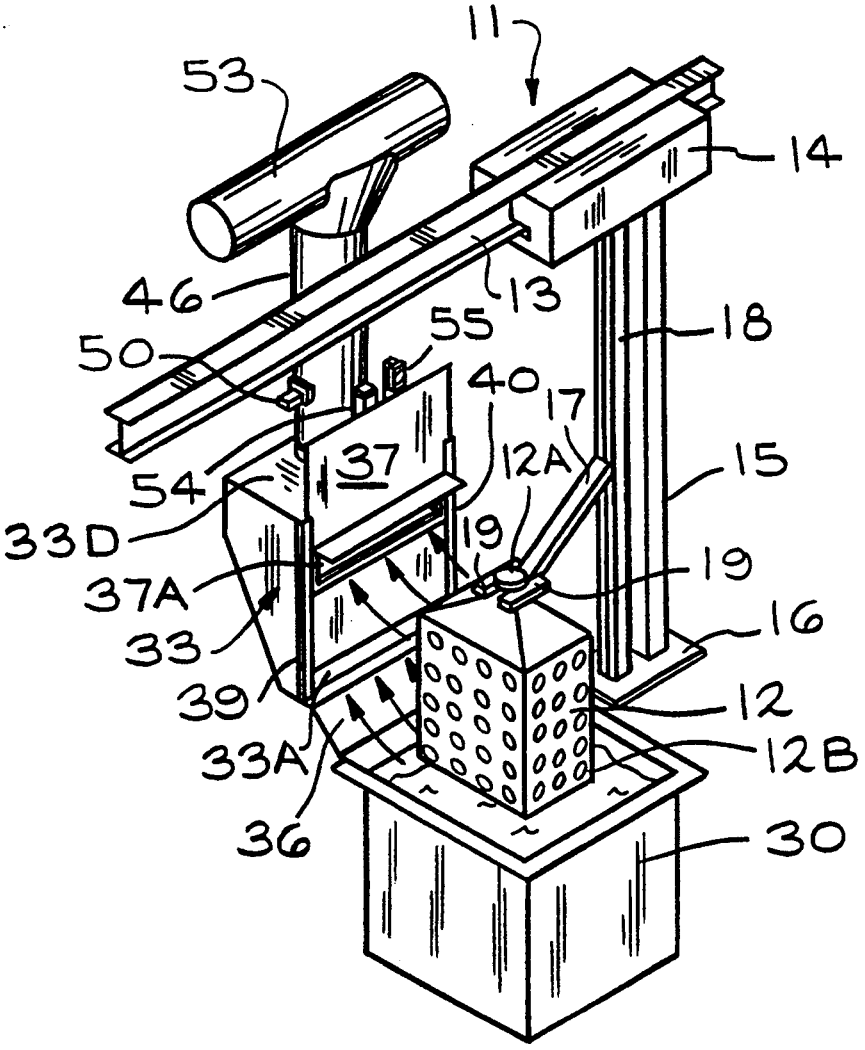
FIG. 5 is an isometric view showing the operation of the hood 33 when a fixture 12 is removed from a tank 30.
Figure 6:
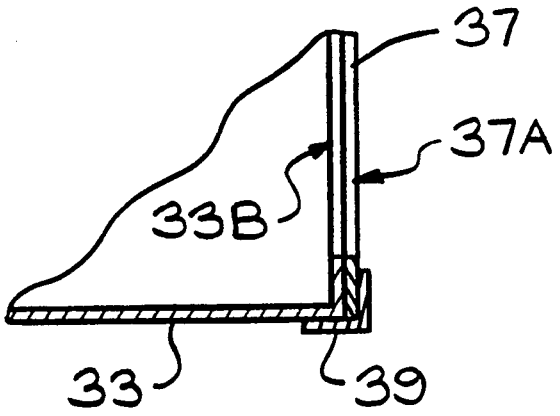
FIG. 6 is a partial cross-section along line 6—6 of FIG. 4 showing the slide 39 for holding the door 37 in position.

The hoods 33, 34 and 35 are provided with permanent openings 33A, 34A and 35A. FIGS. 2, 3, 4, 5 and 6 show one hood 33 which will be described in more detail. The other hoods 34 and 35 are identical in construction. A second opening 33B is provided in the hood 33. The opening is covered by a vertically slidable door 37 with an opening 37A. A deflector 38 is mounted on the door 37 which directs the air towards opening 37A and through opening 37B when the door is in the proper aligned position as shown in FIG. 5. Slide bars 39 and 40 are vertically mounted on the hood 33 on either side of the opening 33B. The hood 33 is tapered in side view towards the bottom 33C so that airflow is directed upwards without stagnating. A vent port 41 with flange 41A is provided through the top 33D of the hood 33 through opening 42. A support member 43 is mounted on the top 33D by gussets 44 and 45 such that there is a horizontal space between the door 37 and the member 43, which are mounted parallel to each other. A stack pipe 46 is mounted on the port 41 such that flange 46A is abutted against flange 41A. A damper 47 comprised of plates 47A and 47B (FIG. 4) is mounted inside the pipe 46 on a rod 48 which is mounted across the pipe 46. Rod 48 is secured to pneumatic motor 50 by pin 50A. The damper 47 can be operated electrically or pneumatically. A cap 49 is mounted on one end and the motor 50 is mounted on the other end of the rod 48 on mount 51 secured to the pipe 46 by bolts 52. As can be seen, the damper 47 pivots in the pipe to partially close or essentially completely open the passage 46B in the pipe 48. The pipe 46 leads to a common exhaust manifold 53 (FIGS. 1 and 5) which exits the air from the hood 33 by means of a suction fan (not shown).

Figure 2:
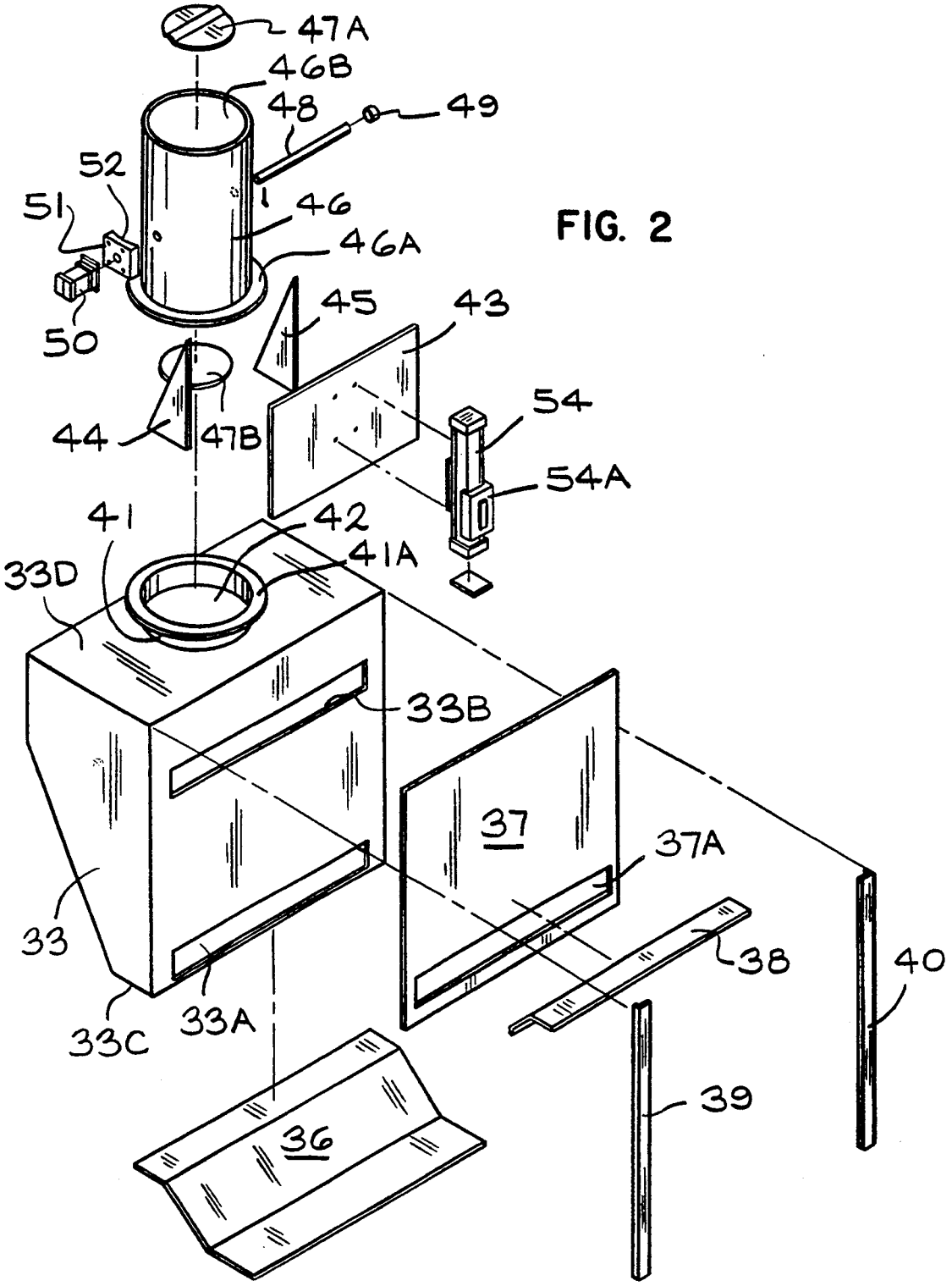
FIG. 2 is a separated isometric view showing a single ventilation hood 33 used in the system of the present invention.
Figure 3:
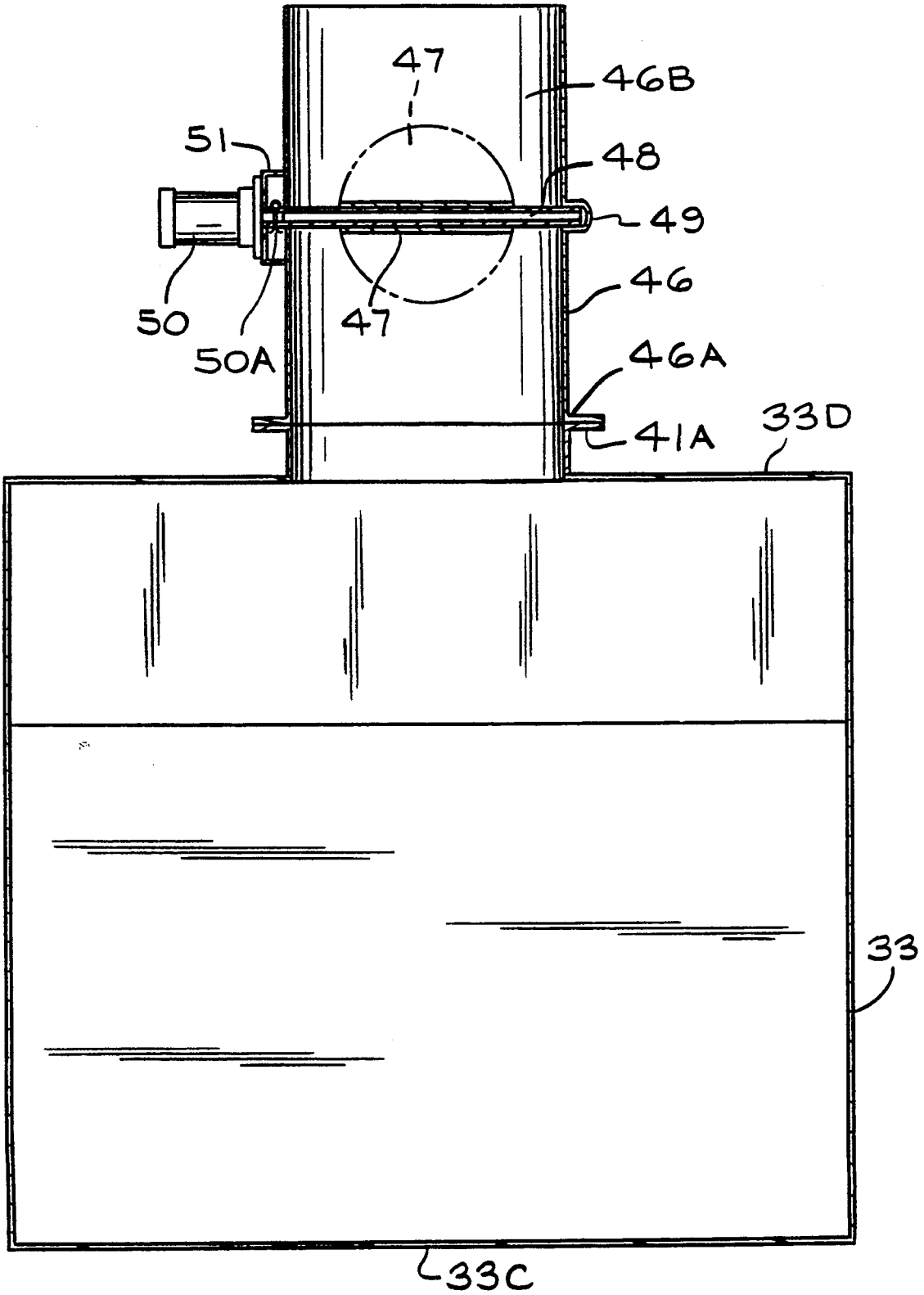
FIG. 3 is a front cross-sectional view along line 3—3 of FIG. 1 particularly showing a damper 47 used in the hood.
Figure 4:
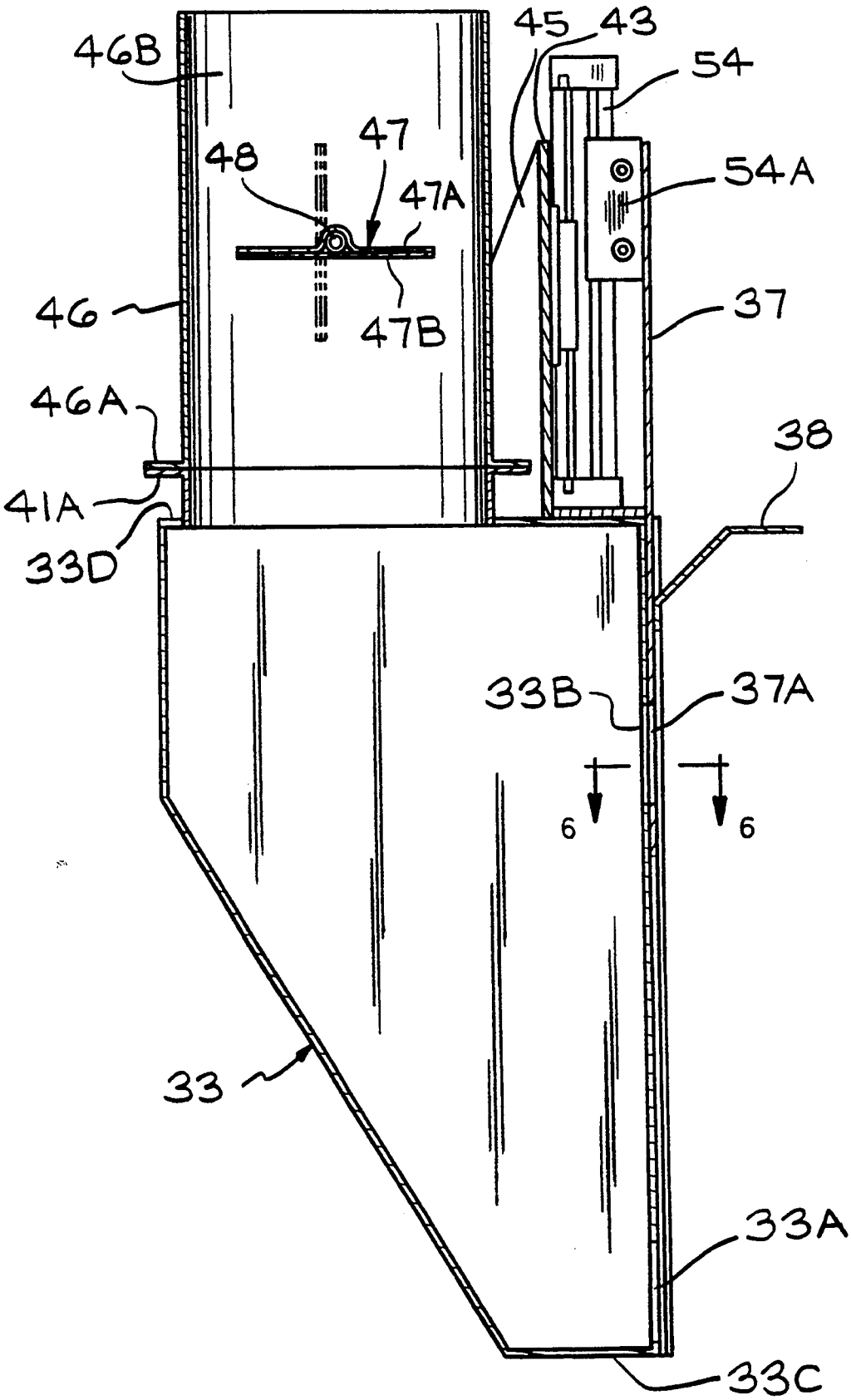
FIG. 4 is a side cross-sectional view of hood 33 along line 4—4 of FIG. 1 showing the damper 47 and the pneumatic lift unit 54 for opening and closing the door 37.

As shown in FIGS. 1, 2 and 5, the door 37 is opened by means of a pneumatic lift unit 54 (preferably a rodless band cylinder; Tol-O-Matic, Inc. located at Minneapolis, Minn.) mounted on member 43 with the moveable element 54A secured to the door 37. A proximity switch 55 (manufactured by Effector, located at Exton, Pa.) detects when the fixture 12 is being raised and opens a valve (not shown) in solenoid valve 60, 61 and 62 (FIG. 7) so that air is supplied to lift unit 54 via lines 57 to open the door 37. The unit 54 can also be electrically operated. As shown in FIG. 1, the source of air is through supply line 57A. The signal from the switch 55 is sent electrically to a control unit(s) 56 via line 58. The control 56 opens the solenoid valve 60, 61 or 62. This in turn opens cover 37 and damper 47. The damper 47 is opened. Thus, the door 37 covers the opening 33B until the fixture 12 is removed from the tank 30 when more air is needed.

An air supply pipe 59 is provided across the tanks 30, 31 and 32 adjacent to the surface of liquids $L_1$, $L_2$ and $L_3$ which directs a current of air through a slot or nozzles (not shown) across the surfaces. In this manner there is a continuous flow of air through openings 33A, 34A and 35A from pipe 59 so that there is positive venting at all times.

As can be seen from FIGS. 1 and 5, the fixture 12 is raised and lowered into tanks 30, 31 and 32 in succession. Tank $L_1$ contains a cleaning fluid for the workpieces in the fixture 12. In practice, there can be multiple cleaning tanks like tank 30 prior to plating. As shown in FIG. 5, when the fixture 12 is lifted from the tank 30, the door 37 is raised by lift unit 54 so that openings 33B and 37A are in line, thus allowing air to flow through the openings 33B and 37A. The greater volume of air is needed since the fumes are venting from the workpieces and fixture 12. The system is preferably designed so that there is a pause which allows all of the fluid to drain back into the tank 30. The door 37 is then moved down on the hood 33 on slide bars 39 and 40 so that the opening 33B is closed. The air is continuously flowing through opening 33A so that there is no loss of fumes to the environment around the tank 30 before, during or after the removal of the fixture 12 from the tank. In succession, the same operation is repeated in tanks 31 and 32. The liquid $L_2$ in tank 31 is usually a plating bath and the liquid $L_3$ in tank 32 is usually a washing bath.

The motor 50 activates the damper 47 when there is a need for a large air flow such as during removal of the fixture 12, usually when the door 37 is opened. When the liquids $L_1$, $L_2$ and/or $L_3$ are not in use and there is a relatively low need for air flow the damper 47 is closed. Preferably, the motor 50 is used and controlled to open the damper 47 along with the opening of the door 37 by means of the computer 100. The operation of the switch 55 thus also activates the motor 50. It is possible that the opening of the damper 47 could be mechanically controlled by a linkage connected to the door 37 (not shown); however this is not preferred.

Numerous variations will occur to those skilled in the art. Conveyors, such as conveyor 11, are commercially available and operate in many different ways to raise, lower and move the fixture 12. The fixture 12 is merely illustrative and numerous types of hangers for workpieces are well known to those skilled in the art. The hoods 33, 34 or 35 can have different cross-sectional shapes and can have more than one door 37. The doors can open and close in any conventional manner, such as by pivoting. The venting of the pipes 46 can be accomplished individually, rather than by use of the manifold 53. All of these variations are obvious to those skilled in the art.

Preferably, automated hoods 33, 34 and 35 are used in conjunction in an industrial ventilation system for removing fumes/mists from process tanks 30, 31 and 32 surfaces and the corresponding fixtures 12 being removed from the process tanks 30, 31 or 32. The hoods 33, 34 and 35 operate in a normally restricted mode (bottom slot 33A opened for tank 30, 31 and 32 surface ventilation only the majority of the time). Once a lifting device 17 positions itself in front of the hood 33, the proximity switch 55 signifies its presence and signals the switch 55 as to cause the door 37 and corresponding damper 37 to open allowing fumes coming off the elevated fixture 12 to be removed. A computer could be used to automate the operation. Once the lifting mechanism 17 transfers away from the hood or sensor the switch 55 is once again signaled and reverses the process, therefore closing off the upper slots 33B and returning the damper 47 to its semi-closed position. This process of the hoods 33, 34 and 35 upper slots 33B and damper 47 opening and closing on demand in a fully automatic operation, while allowing the lower slots 33A to remain open (bottom slots 33A constantly maintain control over the process bath surface) is unique. The user has maximum control over the ventilation system with minimal exhaust air volumes being required.

Figure 7:
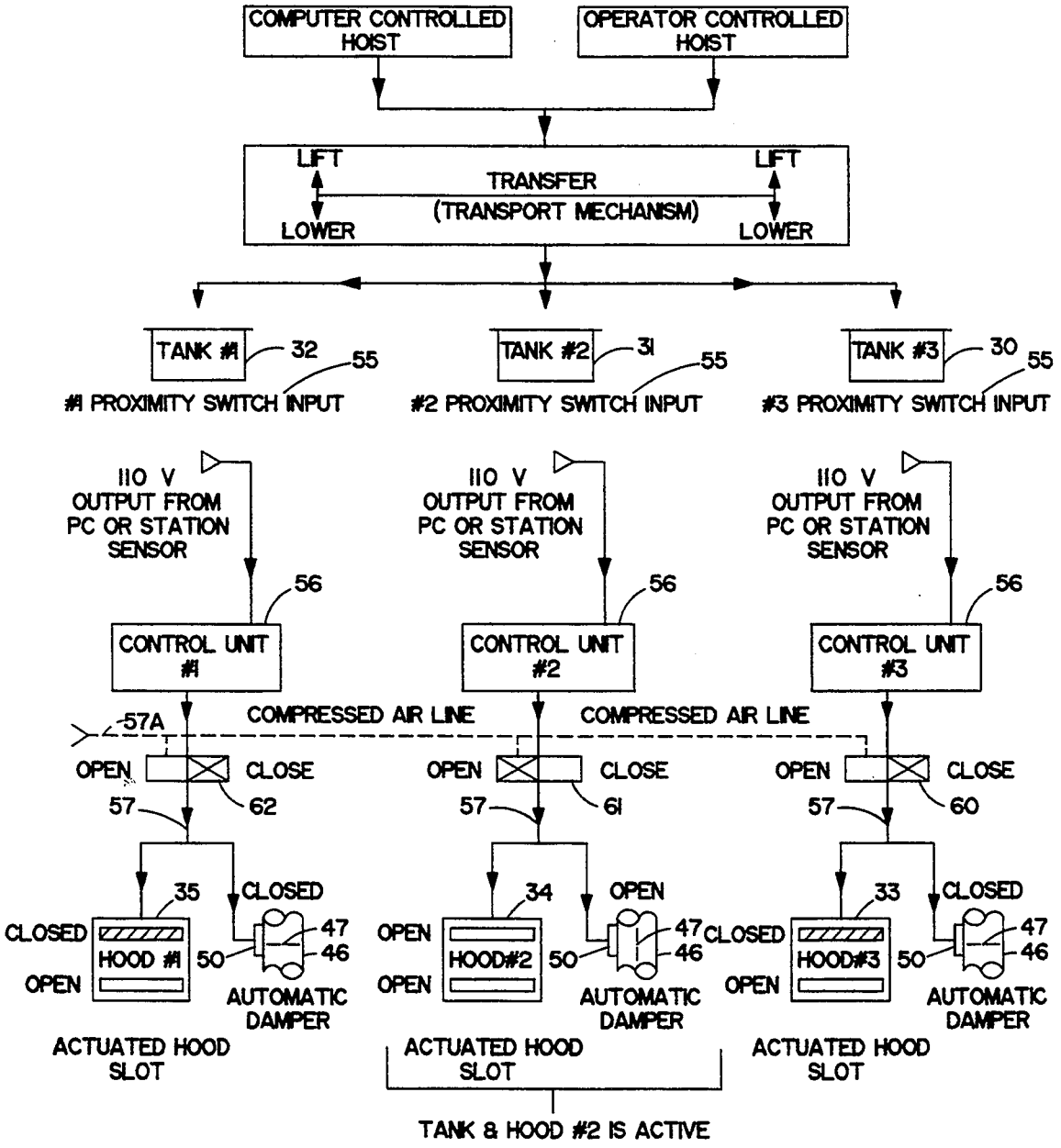
FIG. 7 is a schematic view of the system showing a proximity switch 55 which controls lift unit 54 as shown in FIG. 1 for hoods 33, 34 and 35.

The sequence of operation of the system 10 and conveyor 11 is shown in FIG. 7.

(1) The conveyor 11 is operated either in an automatic or manual mode is positioned in front of a hood 33, 34 or 35.

(2) Once the conveyor 11 is positioned, an on-station signal from switch 55 is sent to the control unit 56.

(3) The control unit 56 upon receiving the on-station signal activates the air-controlled solenoid valve 60, 61 or 62.

(4) The valve 60, 61 or 62 switches open allowing air pressure to the door 37 to raise, exposing the upper slot or slots 33B in conjunction with opening the corresponding damper 47 for allowing the predetermined additional exhaust volume to be drawn from the tank 33, 34 or 35 surface and the parts in fixture 12.

(5) This condition is maintained as long as the conveyor 11 and fixture 12 are present.

(6) Once the conveyor 11 and fixture 12 transfers away from the active station, the door 37 reverts back to a rest position; meaning that the door 37 and damper 47 go back to a closed and particularly open position, respectively, allowing only the tank 33, 34 or 35 surface to be exhausted. In FIG. 7, the door 37 of hood 34 is open as shown.

The advantages of the present invention are:

1. Much smaller control equipment (i.e. scrubbers, fan and duct sizes) due to significantly lower air volumes, to obtain the same control over the process baths and fixtures.

2. Lower power consumption (i.e. gas and electrical, due to smaller motors, less make-up air to reheat and in some cases to cool and reestablish the air being exhausted from said facility.

3. Decreased loading to the waste water treatment system. Smaller control systems require less make-up water to aid in the scrubbing process.

4. Decreased chemical usage (again due to smaller control equipment and less recirculation water the amount of chemical required to aid in the scrubbing process decreases dramatically not only in the scrubber recirculation system but the amount of chemical required to neutralize this effluent once the discharge reaches the waste water treatment system.

5. Smaller fan motors and pumps due to the decreased volumes result in much lower maintenance costs over the life of the system.

The hood system of the present invention is very efficient and cost effective and is a significant contribution to the industrial ventilation industry today. There is particularly a need in metal finishing industry for cost effective systems to aid the financial burden of end user and ultimately the consumer, while significantly decreasing the demise of our natural resources which have been taken for granted far too long.

It is intended that the foregoing description be illustrative of the present invention and that the present invention be limited only by the hereinafter appended claims.

We claim:

1. An apparatus to be mounted adjacent to a tank means for removing vapors from the tank means which comprises:

(a) ventilation hood means to be mounted adjacent to the tank means for removing the vapors and exhausting the vapors from the tank means and having at least one opening into the hood means adjacent the tank means, the one opening having a moveable cover means wherein in use periodically the cover means on the one opening is adapted to open to remove vapors from the tank; and (b) a control means which opens the cover means to remove the vapors.

2. The apparatus of claim 1 wherein the cover means is a plate which slides vertically to open and close the one opening.

3. The apparatus of claim 2 wherein the plate is flat with opposed vertically oriented sides and wherein the hood means is provided with opposed channels which slidably mount the plate on the sides.

4. The apparatus of claim 3 wherein a linear motive means is mounted on the hood means and on the plate to move the plate to open and close the one opening.

5. The apparatus of claim 4 wherein the motive means is pneumatically or electrically operated.

6. The apparatus of claim 1 wherein an exhaust pipe means is provided from the hood means which connects to a common pipe for removing the vapors from the hood means.

7. The apparatus of claim 1 wherein an exhaust pipe means is provided from the ventilation hood means and wherein a damper means is provided on the exhaust pipe means for regulating air flow through the exhaust pipe means as a function of the vapors being generated by the bath.

8. The apparatus of claim 7 wherein the damper means is activated pneumatically or electrically.

9. The apparatus of claim 1 wherein the opening of the cover means is controlled by a control means which activates a motive means to open and close the cover means.

10. The apparatus of claim 1 wherein there is a separate uncovered opening into the ventilation hood means.

11. An apparatus which comprises:

(a) tank means for providing a bath for an article;

(b) ventilation hood means for removing vapors from the bath and exhausting the vapors from the hood means mounted adjacent the tank means and having at least one opening into the hood means adjacent to and above an upper surface of the bath, the one opening having a moveable cover means, wherein in use periodically the cover means on the one of the openings is adapted to open as the article is removed from the bath.

12. The apparatus of claim 11 wherein the cover means is a plate which slides vertically to open and at least partially close the one of the openings.

13. The apparatus of claim 12 wherein the plate is flat with opposed vertically oriented sides and wherein the hood means is provided with opposed channels which slidably mount the plate on the sides.

14. The apparatus of claim 13 wherein a linear motive means is mounted on the hood means and on the plate to move the plate to open and close the one of the opening.

15. The apparatus of claim 14 wherein the motive means is pneumatically or electrically operated.

16. The apparatus of claim 11 wherein an exhaust pipe means is provided from the hood means which connects to a common pipe for removing the vapors from the hood means.

17. The apparatus of claim 11 wherein an exhaust pipe means is provided from the ventilation hood means and wherein a damper means is provided on the exhaust pipe means for regulating air flow through the exhaust pipe means as a function of the vapors being generated by the bath.

18. The apparatus of claim 17 wherein the damper means is activated pneumatically or electrically.

19. The apparatus of claim 11 wherein the tank means is provided with an air supply conduit which flows air across the surface of the bath towards the ventilation hood means and wherein there is an uncovered opening in the ventilation hood means for removing the air.

20. The apparatus of claim 19 wherein the conduit is air supply pipe mounted adjacent a side of the tank opposite the hood means with perforations adjacent to the surface of the bath.

21. The apparatus of claim 11 wherein the opening of the cover means is controlled by a control means.

22. The apparatus of claim 11 wherein the opening of the cover means is controlled by a control means which activates a motive means to open and close the cover means.

23. An electroplating apparatus which comprises:

(a) multiple, sequentially arranged tank means providing separate stations for a cleaning bath, a plating bath and rinsing bath for an article which is plated;

(b) ventilation hood means for removing vapors from at least one of the baths and exhausting the vapors from the hood means mounted adjacent at least one of the tank means providing one of the baths and having at least one opening into the hood means adjacent to and above an upper surface of the one of the baths, the one opening having a moveable cover means, wherein in use periodically the cover means on the one opening is adapted to open as articles are removed from the one of the baths.

24. The apparatus of claim 23 wherein the ventilation hood means is provided adjacent to each of the baths.

25. The apparatus of claim 23 wherein the cover means is a plate which slides vertically to open and close the one opening.

26. The apparatus of claim 25 wherein the plate is flat with opposed vertically oriented sides and wherein the hood means is provided with opposed channels which slidably mount the plate on the sides.

27. The apparatus of claim 26 wherein a linear motive means is mounted on the hood means and on the plate to move the plate to open and close the one opening.

28. The apparatus of claim 27 wherein the motive means is manually, pneumatically or electrically operated.

29. The apparatus of claim 23 wherein the articles are provided in a fixture means which is moved between the stations by a transfer means.

30. The apparatus of claim 29 wherein the transfer means includes a vertically moveable arm which engages and moves the fixture means between the stations.

31. The apparatus of claim 30 wherein the fixture means is provided with a pickup means which is engaged by a mounting means on the transfer means.

32. The apparatus of claim 23 wherein an exhaust pipe means is provided from the hood means which connects to a common pipe for removing the vapors from the hood means.

33. The apparatus of claim 23 wherein an exhaust pipe means is provided from the ventilation hood means and wherein a damper means is provided on each of the exhaust pipe means for regulating air flow through the exhaust pipe means as a function of the vapors being generated by the bath.

34. The apparatus of claim 33 wherein the damper means is activated pneumatically or electrically.

35. The apparatus of claim 23 wherein the tank means is provided with an air supply conduit which flows air across the surface of the bath towards the ventilation hood means and wherein there is an uncovered opening in the ventilation hood means for removing the air.

36. The apparatus of claim 35 wherein the conduit is air supply pipe mounted adjacent a side of the tank opposite the hood means with perforations adjacent to the surface of the bath.

37. The apparatus of claim 29 wherein a sensor means detects movement of the transfer means when the fixture means is removed from the tank means.

38. The apparatus of claim 37 wherein the sensor means is mounted on the hood means.

39. The apparatus of claim 38 wherein the sensor means is mounted adjacent to the moveable cover means.

40. The apparatus of claim 23 wherein the opening of the cover means is controlled by a control means.

41. The apparatus of claim 23 wherein the opening of the cover means is controlled by a control means which activates a motive means to open and close the cover means.

42. A method for removing vapors from a bath in a tank means;

(a) providing an apparatus to be mounted adjacent to a tank means for removing vapors from the tank means which comprises: ventilation hood means for removing the vapors and exhausting the vapors from the tank means and having at least one opening into the hood means adjacent the tank means, the one opening having a moveable cover means wherein in use periodically the cover means on the one opening is opened to remove vapors from the tank; and (b) removing the vapors from the bath in the tank means with the hood means, wherein the one opening is periodically opened to remove the vapors from the tank.

43. A method for electroplating which comprises:

(a) providing an electroplating apparatus which comprises multiple, sequentially arranged tank means providing separate stations for a cleaning bath, a plating bath and rinsing bath for an article which is plated; ventilation hood means for removing vapors from at least the bath used for the electroplating and exhausting the vapors from the hood means mounted adjacent the tank means providing one of the baths and having at least one opening into the hood means adjacent to and above an upper surface of the bath, the one opening having a moveable cover means, wherein in use periodically the cover means on the one opening is opened as articles are removed from the bath; and (b) electroplating the article in the tank means using the apparatus, wherein the one opening is opened as the electroplated articles are removed from the bath.

* * * * *